US008595937B2

(12) United States Patent
Shuraim

(10) Patent No.: US 8,595,937 B2
(45) Date of Patent: Dec. 3, 2013

(54) METHOD FOR FABRICATING A REINFORCED WIDE SHALLOW CONCRETE BEAM WITH INCREASED SHEAR RESISTANCE EFFICIENCY

(76) Inventor: Ahmed B. Shuraim, Riyadh (SA)

( * ) Notice: Subject to any disclaimer, the term of this patent is extended or adjusted under 35 U.S.C. 154(b) by 434 days.

(21) Appl. No.: 13/110,396

(22) Filed: May 18, 2011

(65) Prior Publication Data

US 2012/0291286 A1 Nov. 22, 2012

(51) Int. Cl.
*B21D 49/00* (2006.01)

(52) U.S. Cl.
USPC ..... 29/897.34; 29/897; 29/897.3; 29/897.33; 29/897.35

(58) Field of Classification Search
USPC ..... 29/897, 897.3, 897.33, 897.34, 897.35
See application file for complete search history.

(56) References Cited

U.S. PATENT DOCUMENTS

| | | | | |
|---|---|---|---|---|
| 3,283,458 | A | 11/1966 | Gersovitz | |
| 4,105,739 | A | 8/1978 | Dave | |
| 4,573,013 | A * | 2/1986 | Kusenberger et al. | 324/238 |
| 4,702,052 | A * | 10/1987 | Chow | 52/223.2 |
| 6,385,930 | B1 | 5/2002 | Broms et al. | |
| 7,523,924 | B2 * | 4/2009 | Melancon | 267/166 |
| 7,529,650 | B2 * | 5/2009 | Wakelam et al. | 703/1 |
| 8,196,368 | B2 * | 6/2012 | Sarraf | 52/745.21 |
| 2007/0039276 | A1 | 2/2007 | Sorensen | |

* cited by examiner

*Primary Examiner* — Richard Chang
(74) *Attorney, Agent, or Firm* — Jason L. Gilbert

(57) ABSTRACT

A method for fabricating a reinforced concrete beam which greatly increases the effectiveness of stirrups in contributing to shear resistance. The method for fabricating a reinforced concrete beam generally includes the steps of positioning a plurality of rebars parallel with respect to each other to form the internal reinforced frame of the beam. A plurality of stirrups may then be extended around the plurality of rebars to provide additional support. An equivalent spacing value is computed in terms of transverse spacing ($s_w$), longitudinal spacing ($s_L$) and effective depth (d) and efficiency is then maximized in light of practical considerations by varying the transverse spacing ($s_w$), In a preferred embodiment, after calculating the longitudinal spacing ($s_L$) of the stirrups and the effective depth (d) of the rebars, the stirrups are positioned within the rebars using a transverse spacing ($s_w$) calculated by the following equation:

$$s_w = \left(\frac{s_L}{d}\right)^{0.5} d.$$

15 Claims, 7 Drawing Sheets

| Casting Group | $f'c$ MPa | $fyv$ MPa | STIRRUP CONFIGURATION | $Sw$ mm | $Av$ mm² | $d$ mm | $S_L$ mm | $\frac{A_v d}{S_L}$ | Total load,kN |
|---|---|---|---|---|---|---|---|---|---|
| I | 29 | 483 |  | - | - | 152 | - | - | 474 |
| | 29 | 483 |  | 660 | 157 | 152 | 80 | 300 | 644 |
| | 29 | 483 |  | 440 | 157 | 152 | 80 | 300 | 647 |
| | 29 | 483 |  | 230 | 157 | 152 | 80 | 300 | 677 |
| II | 28 | |  | - | - | 149 | - | - | 470 |
| | 28 | 465 |  | 660 | 201 | 149 | 75 | 400 | 471 |
| | 28 | 465 |  | 230 | 201 | 149 | 75 | 400 | 642 |
| | 28 | 465 |  | 230 | 201 | 149 | 75 | 400 | 800 |
| | 28 | 465 |  | 230 | 201 | 149 | 100 | 300 | 782 |
| | 28 | 465 | | 230 | 201 | 149 | 125 | 240 | 703 |
| III | 30 | |  | - | - | 149 | - | - | 464 |
| | 30 | 465 |  | 660 | 201 | 149 | 75 | 400 | 701 |
| | 30 | 465 |  | 230 | 201 | 149 | 75 | 400 | 703 |
| | 30 | 465 |  | 230 | 201 | 149 | 75 | 400 | 893 |
| | 30 | 465 | | 230 | 201 | 149 | 100 | 300 | 812 |
| | 30 | 465 | | 230 | 201 | 149 | 125 | 240 | 702 |

METHOD FOR FABRICATING A REINFORCED WIDE SHALLOW CONCRETE BEAM WITH INCREASED SHEAR RESISTANCE EFFICIENCY

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to the construction of reinforced concrete beams and more specifically it relates to a method for fabricating a reinforced wide shallow concrete beam with increased shear resistance efficiency which greatly increases the effectiveness of stirrups in contributing to shear resistance.

2. Description of the Related Art

Any discussion of the related art throughout the specification should in no way be considered as an admission that such related art is widely known or forms part of common general knowledge in the field.

Reinforced concrete beams have been in use for years in building constructions. Wide beams in concrete buildings are generally constructed to be hidden by designing the wide beams to have the same depth as the supported floor (i.e. in a joist construction). Such wide shallow beams are generally supported on elongated columns in constructions of residential buildings.

In the past, shear strength in reinforced concrete beams, or $V_n$, has been calculated as the summation of contributions of concrete and stirrups as shown in the below equation:

$$V_n = V_c + V_{sL}.$$

The first parameter, $V_c$, is the concrete contribution to shear strength and is generally expressed by empirical equations involving a number of influencing parameters. For wide beams, support width has also been considered as an additional parameter which causes geometric differences and induces disturbed force flow.

The second parameter, $V_{sL}$, is the stirrup contribution to shear strength and has previously been formulated for vertical stirrups as:

$$V_{sL} = \frac{A_v f_{yv} d}{s_L},$$

where, $s_L$ is the longitudinal spacing of stirrups, $A_v$ is the vertical legs area, d is the effective depth and $f_{yv}$ is the yield strength of stirrups. However, this equation does not include a direct parameter for the transverse spacing of stirrup legs. Building codes in various countries appear to differ in their treatment of the transverse spacing issue. For example, Eurocode 2 suggests spacing limits of 0.75 d or 600 mm in both the width and longitudinal direction. In contrast, ACI318-08, which was released by the American Concrete Institute, suggests spacing limits of 0.5 d in the longitudinal direction, but does not provide a limit on the leg spacing in the transverse direction.

While there have been numerous studies conducted on the issue, a consensus has yet to be reached regarding the issue of transverse spacing requirements with respect to wide shallow beams. Because of the inherent problems with the related art, there is a need for a new and improved method for fabricating a reinforced wide shallow concrete beam which utilizes new guidelines for computing stirrup contribution to shear strength to ensure adequate safety of wide shallow members for one-way shear.

BRIEF SUMMARY OF THE INVENTION

A method which utilizes new guidelines for computing stirrup contribution to shear strength to ensure adequate safety of wide shallow members for one-way shear. The method pertains to computing and improving the shear stirrup contribution through a configuration efficiency factor (λ) that is related to the form and spacing of the stirrups. The efficiency factor (λ) is integrated into the main design equation to ensure safety and efficiency such as:

$$V_n = V_c + \lambda V_{sL}.$$

The invention generally relates to a method for fabricating a reinforced wide shallow concrete beam which comprises the steps of positioning a plurality of rebars parallel with respect to each other to form the internal reinforced frame of the beam. A plurality of stirrups may then be extended either wholly or partially around the plurality of rebars to provide additional support. Each rebar will generally include a plurality of vertically-extending legs. The transverse spacing ($s_w$) of each leg with respect to the other legs is preferably set to be less than or equal to a maximum value ($s_{w_{max}}$), calculated as a function of the longitudinal spacing ($s_L$) of the stirrups and the effective depth (d) of the beam 20 by the following equation, which maximizes shear strength efficiency:

$$s_{w_{max}} = \left(\frac{s_L}{d}\right)^{0.5} d$$

Concrete may then be poured around the rebars, stirrups and legs to complete the wide shallow concrete beam.

For situations where the transverse spacing ($s_w$) is not complying with the required maximum value ($s_{w_{max}}$) suggested by the above equation (as might happen for practical considerations or in assessing an existing condition), the invention provides the means to assess the actual efficiency factor (λ) that needs to be considered in the shear calculation.

For computing the efficiency factor (λ) for a particular closed configuration, an equivalent spacing ($s_{eq}$) must be computed as $$s_{eq} = \left(\frac{s_L}{d}\right)^{0.25} \sqrt{s_L s_w} \geq s_L$$

Based on the equivalent spacing ($s_{eq}$) and the longitudinal spacing ($s_L$), the efficiency factor (λ) is computed as $$\lambda = S_L / S_{eq}$$

It should be noted that the efficiency factor (λ) can be obtained graphically from FIG. 9 without the need to use the above equations.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
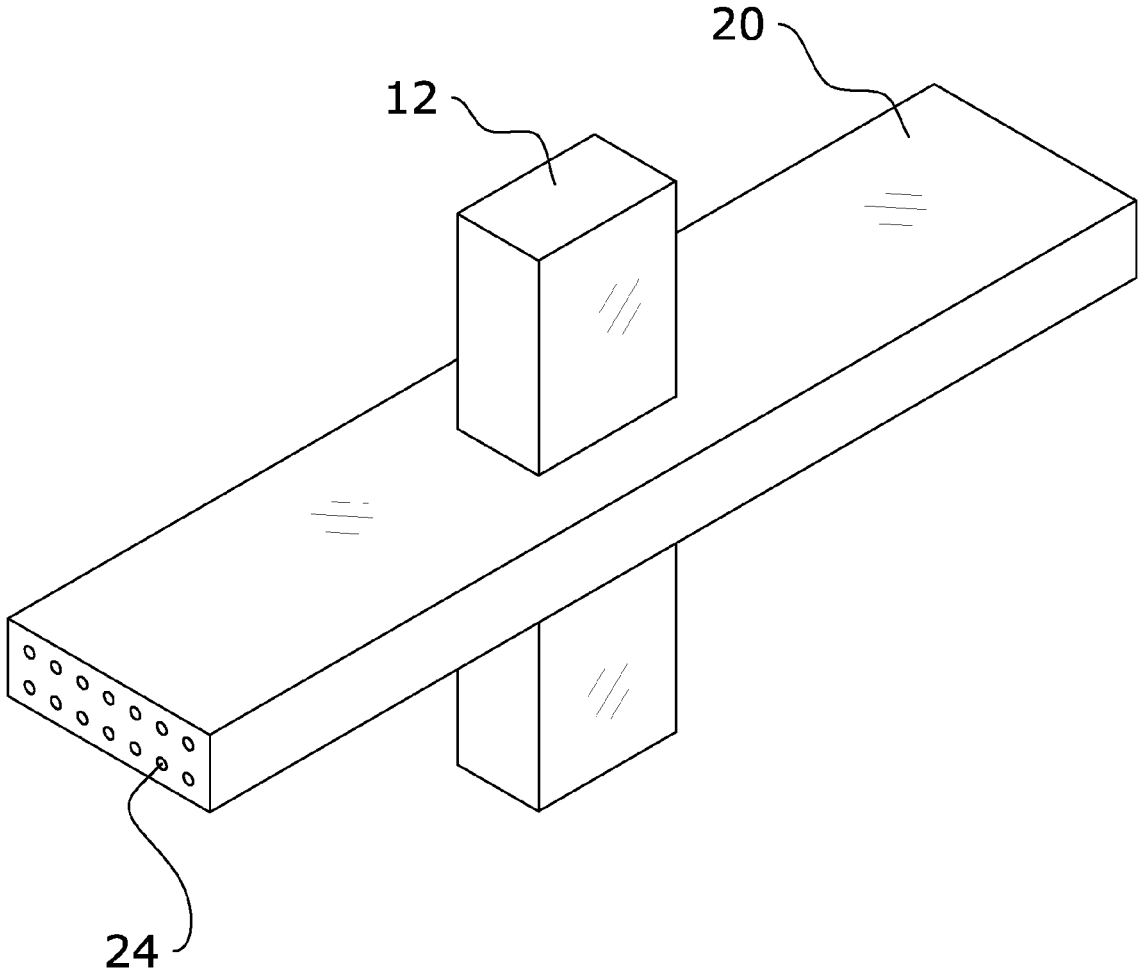
FIG. 1 is an upper perspective view of a wide shallow beam positioned on a column.

A. Overview.

Turning now descriptively to the drawings, in which similar reference characters denote similar elements throughout the several views, FIGS. 1 through 8 illustrate a method for fabricating a reinforced wide shallow concrete beam 20, which comprises the steps of positioning a plurality of rebars 24 parallel with respect to each other to form the internal reinforced frame of the beam 20. A plurality of stirrups 22 may then be extended either wholly or partially around the plurality of rebars 24 to provide additional support. Each rebar 24 will generally include a plurality of vertically-extending legs 26. The transverse spacing ($s_w$) of each leg 26 with respect to the other legs 26 is preferably set to be less than or equal to a maximum value ($s_{w_{max}}$), calculated as a function of the longitudinal spacing ($s_L$) of the stirrups 22 and the effective depth (d) of the beam 20 by the following equation, which maximizes shear strength efficiency:

$$s_{w_{max}} = \left(\frac{s_L}{d}\right)^{0.5} d.$$

Concrete may then be poured around the rebars 24, stirrups 22 and legs 26 to complete the wide shallow concrete beam 20.

For situations where the transverse spacing ($s_w$) is not complying with the required maximum value ($s_{w_{max}}$) suggested by the above equation (as might happen for practical considerations or in assessing an existing condition), the invention provides the means to assess the actual efficiency factor (λ) that needs to be considered in the shear calculation.

For computing the efficiency factor (λ) for a particular closed configuration, an equivalent spacing ($s_{eq}$) must be computed as $$s_{eq} = \left(\frac{s_L}{d}\right)^{0.25} \sqrt{s_L s_w} \geq s_L.$$

Based on the equivalent spacing ($s_{eq}$) and the longitudinal spacing ($s_L$), the efficiency factor (λ) is computed as $$\lambda = S_L / S_{eq}.$$

Figure 9:
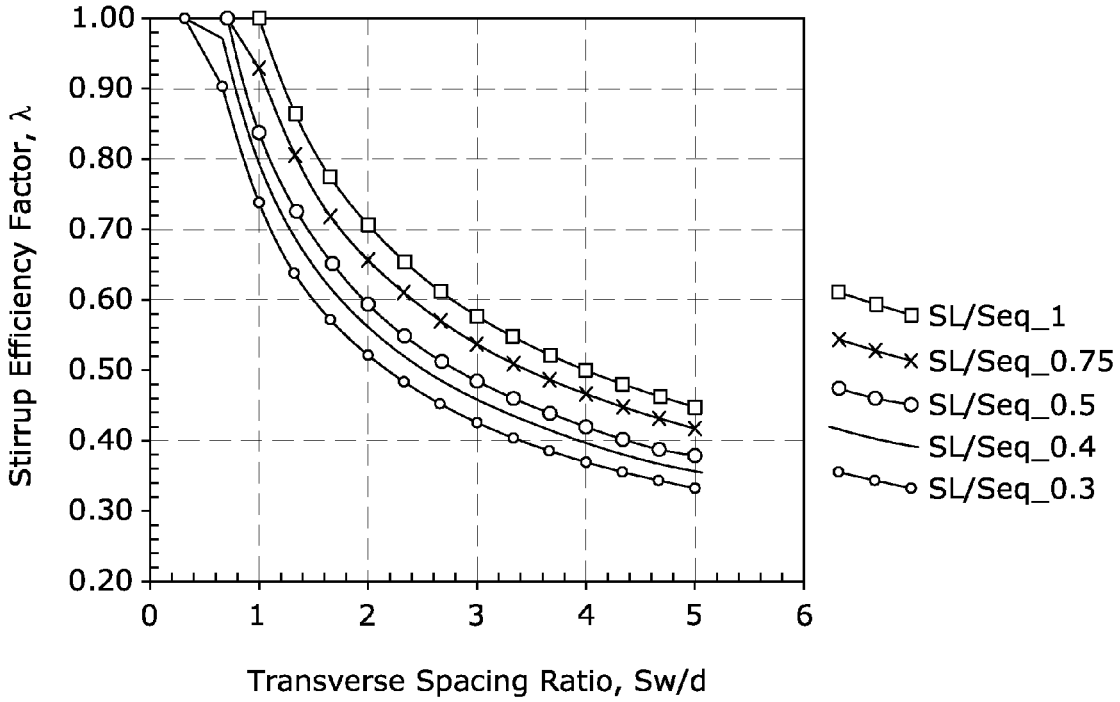
FIG. 9 is a graph illustrating the comparison between stirrup efficiency in resisting shear force and the transverse spacing ratio.

It should be noted that the efficiency factor (λ) can be obtained graphically from FIG. 9 without the need to use the above equations.

The efficiency factor (λ) is integrated into the main design equation to ensure safety and efficiency such as:

$$V_n = V_c + \lambda V_{sL}.$$

B. Reinforced Wide Shallow Concrete Beams.

The present invention is directed toward a method of fabricating reinforced wide shallow concrete beams with increased shear resistance efficiency 20. FIG. 1 is an upper perspective view of an exemplary wide shallow beam 20 positioned on a narrow column 12 as is standard in many current construction projects. However, it is appreciated that the methods described herein should not be construed as being limited to the fabrication of the specific design, shape or size of wide shallow beam 20 shown in the figures.

Figure 2:
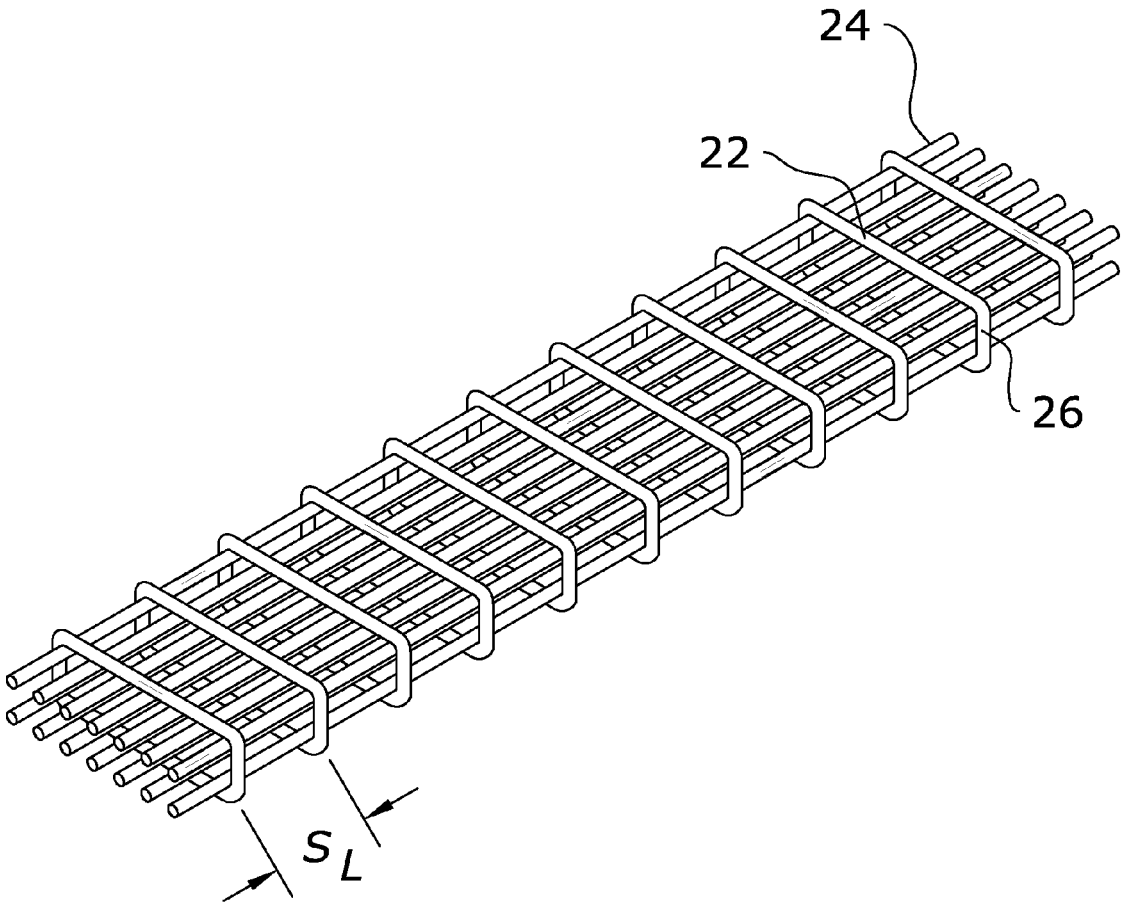
FIG. 2 is an upper perspective view of the interior of a wide shallow beam which shows positioning of rebars and stirrups.

Reinforced wide shallow concrete beams 20 are generally comprised of beams of concrete which include reinforced bars (rebars) 24 incorporated within the concrete itself to strengthen the concrete in tension. Each rebar 24 is generally comprised of an elongated rod comprised of steel or other high durability materials. As shown in FIG. 2, a plurality of rebars 24 will generally extend horizontally through the wide shallow concrete beam 20.

Reinforced wide shallow concrete beams 20 may also include a plurality of stirrups 22 in some configurations. Stirrups 22 are generally comprised of rods of steel or other high durability materials which extend either partially or fully around the plurality of rebars 24 to provide additional tension support. Generally, stirrups 22 will include one or more legs 26 which extend perpendicularly with respect to the horizontally-extending stirrups 22.

Figure 3:
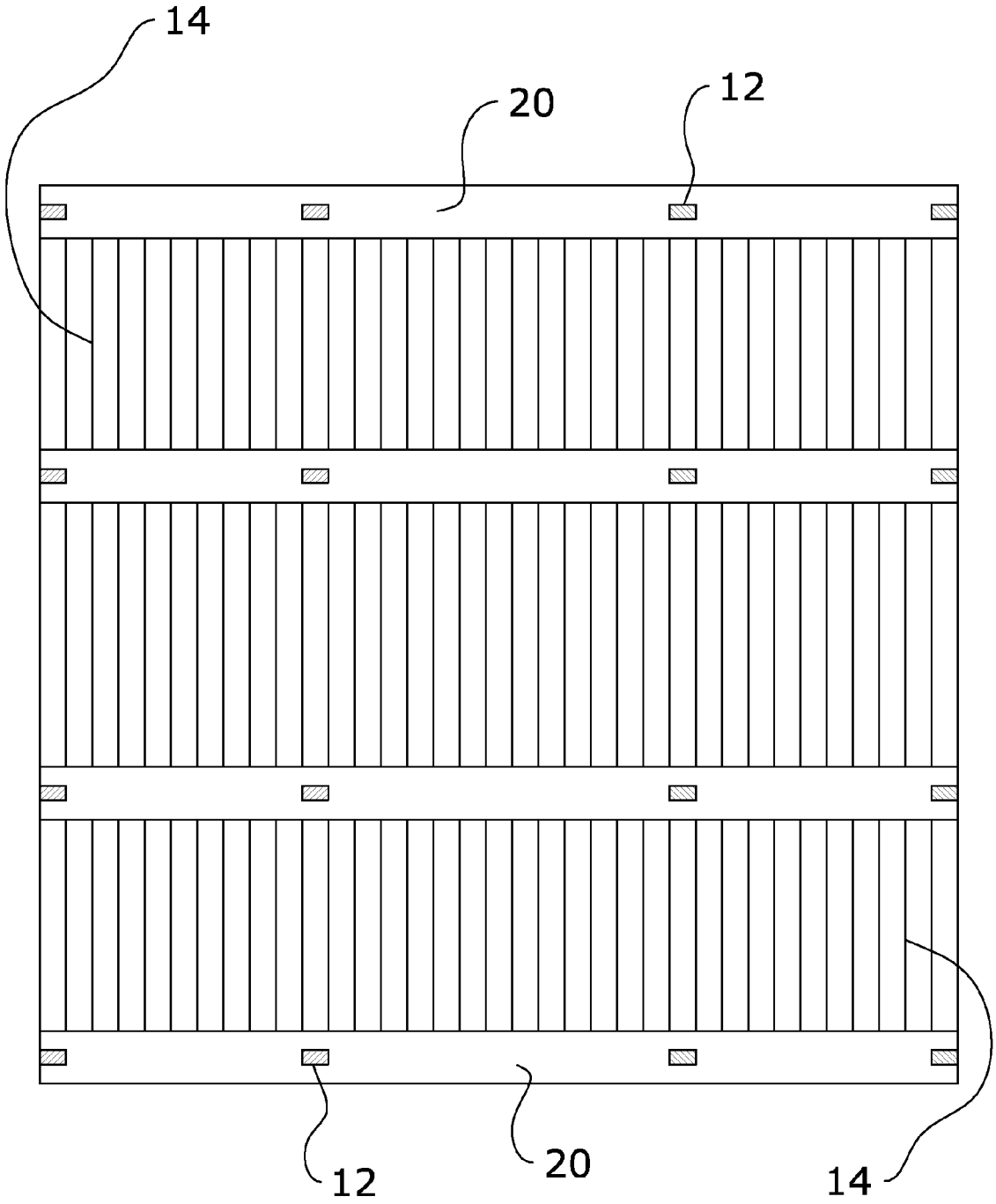
FIG. 3 is a top view of a construction using wide shallow beams, columns and joists.

Wide shallow reinforced concrete beams 20 are generally utilized in constructions in combination with joists 14 and columns 12. As shown in FIG. 3, an exemplary construction is comprised of wide shallow reinforced concrete beams 20 which are positioned horizontally and supported by vertical columns 12. Joists 14 extend perpendicularly with respect to the beams 20 to complete the constructions.

Figure 4:
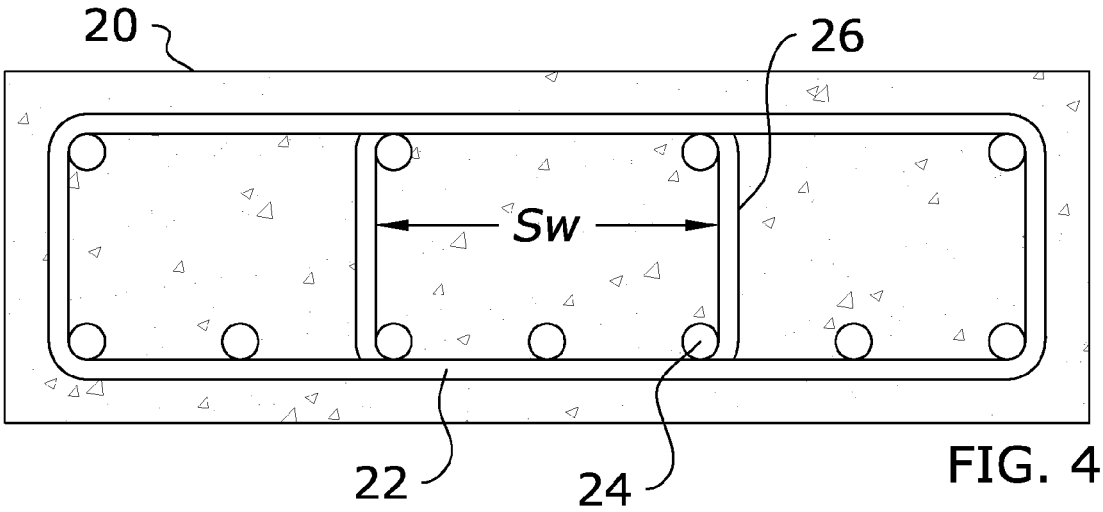
FIG. 4 is a front cutaway view of a multiple-leg closed stirrup configuration.
Figure 5:
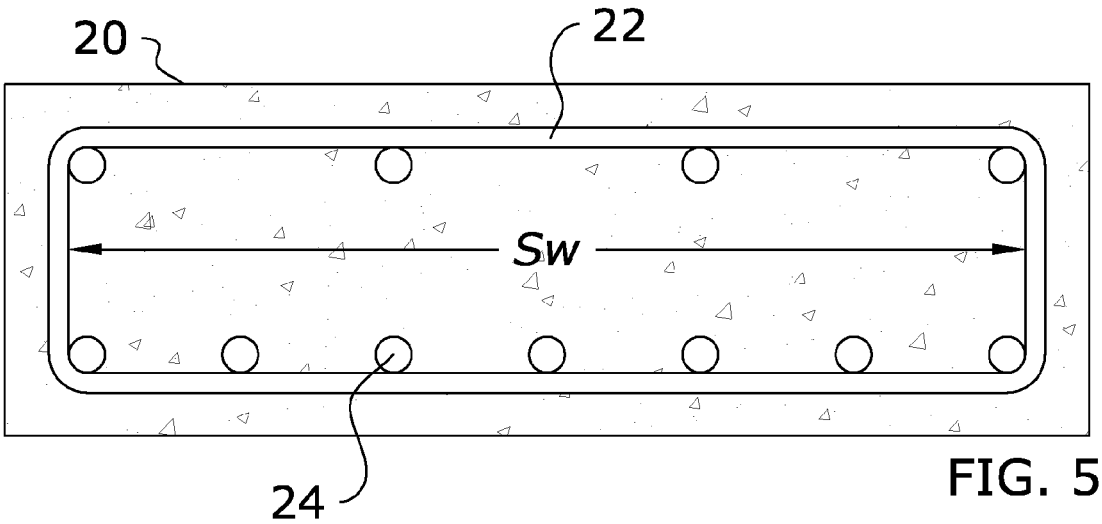
FIG. 5 is a front cutaway view of a two-leg closed stirrup configuration.

Reinforced wide shallow concrete beams 20 may vary in their constructions based on the number, spacing and placement of stirrups 22 and legs 26. FIG. 4 illustrates a common closed stirrup 22 configuration in which the stirrup 22 fully encloses the horizontally extending rebars 24. This figure also illustrates a four-leg configuration which utilizes four vertically extending legs 26 positioned at various locations on the stirrups 22. FIG. 5 illustrates an exemplary closed stirrup 22 configuration which utilizes two vertically extending legs 26.

Figure 6:
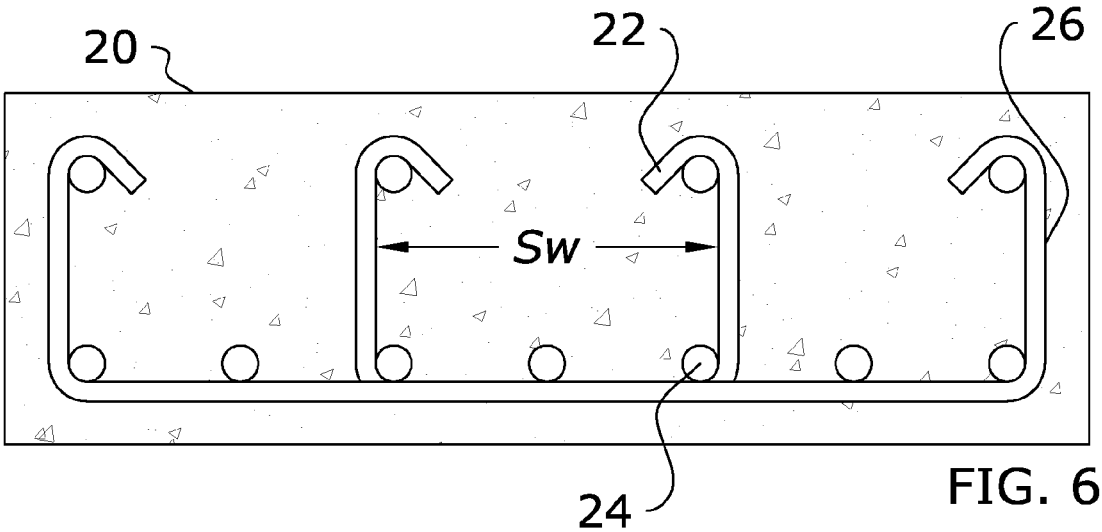
FIG. 6 is a front cutaway view of an open stirrup configuration which is not efficient in resisting shear.

Reinforced concrete beams 20 may also be constructed with an open configuration as shown in FIG. 6. In such a configuration, the stirrups 22 do not completely enclose the rebars 24, but instead simply wrap around rebars 24 at various locations. The configuration shown in FIG. 6 is commonly referred to as a four-leg open stirrup 22 configuration. Test data by the inventor has shown that such open configurations are not efficient in resisting shear and should thus be avoided. The method described in the present application are directed toward calculating the most efficient and shear-resistant configuration and spacing for any given construction project.

C. Calculation of Spacing and Efficiency Factor.

While pre-existing methods of determining proper spacing of stirrups 22 solely utilize longitudinal spacing in their calculations, the methods claimed in the present application utilize a new equivalent spacing value denoted by the symbol $s_{eq}$. This new equivalent spacing value is a function of both transverse spacing ($s_w$) and longitudinal spacing ($s_L$) of stirrups in combination with the effective depth (d) of the beam 20.

Through testing and analysis, the inventor of the present invention has calculated the equivalent spacing as shown in the below equation:

$$s_{eq} = \left(\frac{s_L}{d}\right)^{0.25} \sqrt{s_L s_w} \geq s_L$$

where the longitudinal spacing ($s_L$) is comprised of the horizontal distance between each separate stirrup 22 in a beam 20 and the transverse spacing ($s_w$) is comprised of the horizontal distance between each vertically-extending leg 26 of a stirrup 22. If the equivalent spacing ($s_{eq}$) is calculated as being less than the longitudinal spacing ($s_L$), than the longitudinal spacing ($s_L$) should be utilized for the value of the equivalent spacing ($S_{eq}$).

By utilizing the inventor's proposed equivalent spacing value ($s_{eq}$), more efficient calculations may be made to determine proper stirrup 22 spacing which account for both transverse spacing and longitudinal spacing.

Based on the equivalent spacing ($s_{eq}$) and the longitudinal spacing ($s_L$), the efficiency factor ($\lambda$) is computed as $$\lambda = S_L / S_{eq}.$$

It should be noted that the efficiency factor ($\lambda$) can be obtained graphically from FIG. 9 without the need to use the above equations.

The efficiency factor ($\lambda$) is integrated into the main design equation to ensure safety and efficiency such as:

$$V_n = V_c + \lambda V_{sL}.$$

To determine proper spacing, a maximum limit on the transverse spacing between consecutive legs 26 in a stirrup 22 cross-section is determined. The inventor has determined that the most efficient calculation of transverse spacing limitations is calculated by the below equation, which leads to an efficiency factor ($\lambda$=1):

$$s_{w_{max}} = \left(\frac{s_L}{d}\right)^{0.5} d$$

This equation may be utilized with new wide shallow concrete beam 20 constructions to maximize efficiency of stirrup 22 spacing in contributing to shear strength.

Figure 8:
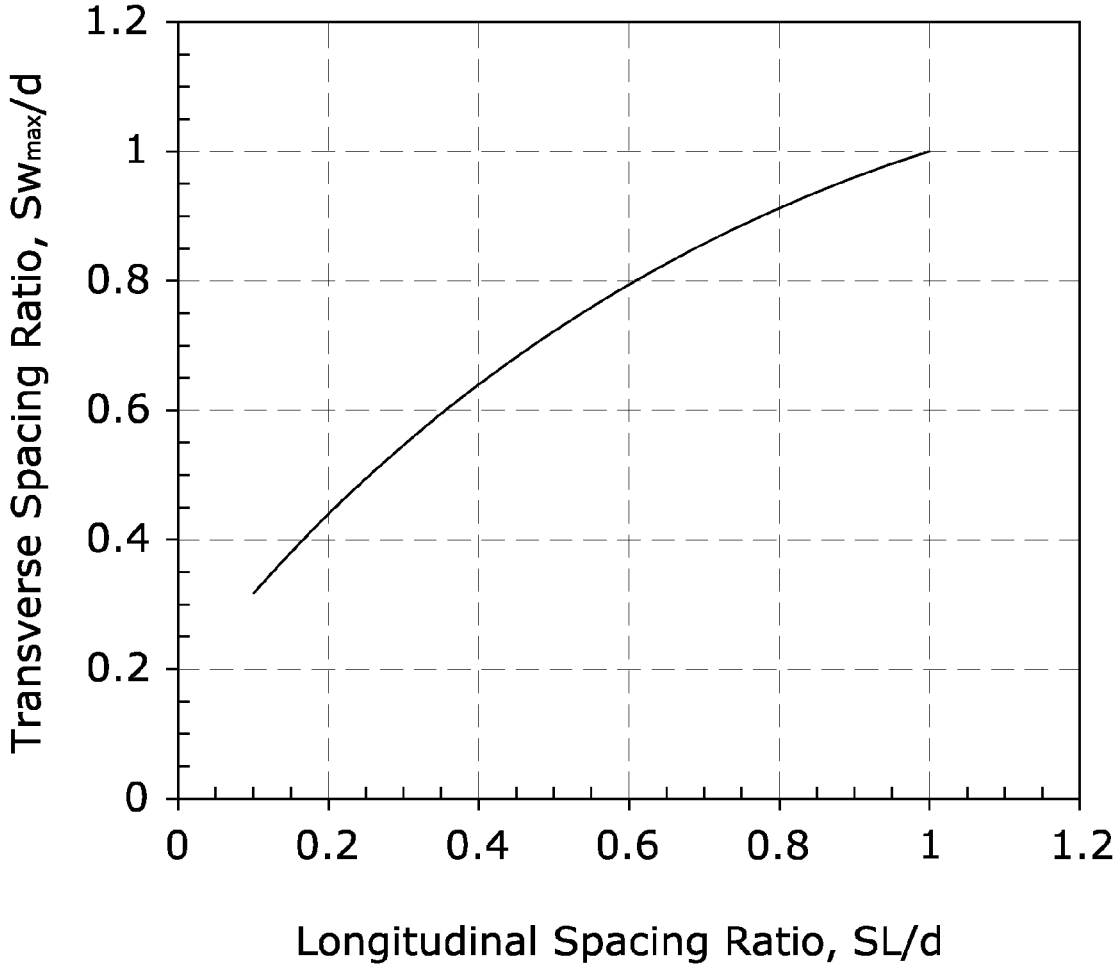
FIG. 8 is a graph illustrating the relationship between the maximum transverse spacing ratio and longitudinal spacing ratio to maximize efficiency.

FIG. 8 is a graph illustrating the relationship between maximum transverse spacing ratio and longitudinal spacing ratio to maximize efficiency. FIG. 9 is a graph illustrating the comparison between stirrup 22 efficiency in resisting shear force and the transverse spacing ratio.

D. Test Data.

Figure 7:
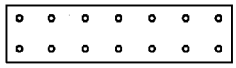
FIG. 7 is a table illustrating data collected from various stirrup configurations.
Figure 7:
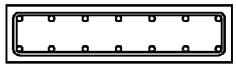
Figure 7:
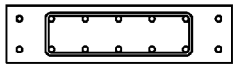
Figure 7:
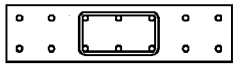
Figure 7:
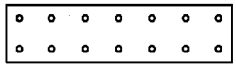
Figure 7:
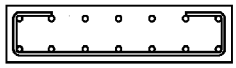
Figure 7:
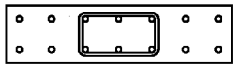
Figure 7:
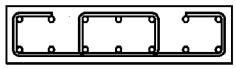
Figure 7:
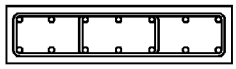
Figure 7:
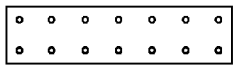
Figure 7:
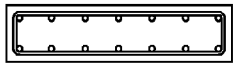
Figure 7:
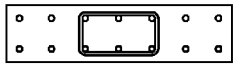
Figure 7:
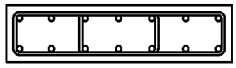

The inventor of the present application conducted a number of tests to confirm that the above equations may be utilized to maximize shear strength in concrete beam 20 constructions. FIG. 7 illustrates test results for a number of configurations to illustrate the application of the principles claimed in the present application.

The test data was compiled by utilizing sixteen specimens of wide shallow reinforced concrete beams 20. The specimens were composed of three groups (I, II, III) based on casting time. The beams 20 in Group I were tested between 35 and 42 days from the time of casting and the beams 20 in Groups II and III were tested between 120 and 180 days from the time of casting.

Various stirrup 22 configurations were tested. Each of the configurations are illustrated by a sectional front view within the table of FIG. 7. Testing stirrup 22 configurations include beams 20 without stirrups 22, two-leg closed stirrup 22 configurations, two-leg open stirrup 22 configurations, four-leg closed stirrup 22 configurations and four-leg open stirrup 22 configurations. Loads were applied to each specimen over full-width plates located at the center of each span. Each specimen was loaded with several load increments up to failure using a displacement control scheme.

The results of the test data showed that beams without stirrups 22 produced consistent concrete shear strength. A comparison with well-known codes and regression equations showed that the concrete shear strength of such no-stirrup 22 configurations was mostly predicted conservatively. Beams 20 with constant amount of stirrups 22 showed clearly that stirrups 22 arranged in four-leg closed configurations were significantly more effective than stirrups 22 arranged in two-leg closed configurations. Beams 20 with four-leg stirrups 22 showed significant and consistent improvement in the contribution of stirrups 22 for shear resistance even when a less area of stirrups 22 was used. The test results made clear that wide shallow beams 20 which are reinforced with two-leg stirrups 22 are susceptible to come shear deficient when shear strength was calculated without accounting for transverse spacing, as has been common in the prior art. Thus, the equivalent spacing calculations were shown to greatly improve stirrup 22 contribution and confirmed that the inventor's transverse spacing limit calculations may be used in order to fully utilize stirrups 22 effectively.

E. Method of Fabrication.

In use, the above concepts may be utilized to construct more wide shallow concrete beams 20 with improved shear strength and efficiency. First, rebars 24 are provided and positioned to form the internal reinforcement structure of the wide shallow concrete beam 20. Preferably closed stirrups 22 are then positioned around the rebars 24 as shown in FIG. 2, with the longitudinal spacing ($s_L$) of the stirrups 22 and the effective depth (d) of the beam 20 being measured. Test data has shown that closed stirrups 22 are preferable for maximizing shear resistance. The proper transverse spacing ($s_w$) of any legs 26 utilized may then be chosen with the maximum limit ($s_{w_{max}}$) calculated from the below equation:

$$s_{w_{max}} = \left(\frac{s_L}{d}\right)^{0.5} d.$$

After a value is determined for the proper transverse spacing ($s_w$), legs 26 may be added, wherein each leg 26 is a distance equal to $s_w$ away from the other legs 26. Concrete may then be poured around the rebars 24, stirrups 22 and legs 26 to complete the wide shallow concrete beam 20.

For situations where the transverse spacing ($s_w$) is not complying with the required maximum value ($s_{w_{max}}$) suggested by the above equation (as might happen for practical considerations or in assessing an existing condition), the invention provides the means to assess the actual efficiency factor (λ) that needs to be considered in the shear calculation.

For computing the efficiency factor (λ) for a particular closed configuration, an equivalent spacing ($s_{eq}$) must be computed as $$s_{eq} = \left(\frac{s_L}{d}\right)^{0.25} \sqrt{s_L s_w} \geq s_L.$$

Based on the equivalent spacing ($s_{eq}$) and the longitudinal spacing ($s_L$), the efficiency factor (λ) is computed as $$\lambda = S_L/S_{eq}.$$

It should be noted that the efficiency factor (λ) can be obtained graphically from FIG. 9 without the need to use the above equations.

The efficiency factor (λ) is integrated into the main design equation to ensure safety and efficiency such as:

$$V_n = V_c + \lambda V_{sL}.$$

The first parameter, $V_c$, is the concrete contribution to shear strength and is generally expressed by empirical equations involving a number of influencing parameters. For wide beams, support width has also been considered as an additional parameter which causes geometric differences and induces disturbed force flow.

The second parameter, $V_{sL}$, is the stirrup contribution to shear strength and has previously been formulated for vertical stirrups as:

$$V_{sL} = \frac{A_v f_{yv} d}{s_L},$$

where, $s_L$ is the longitudinal spacing of stirrups, $A_v$ is the vertical legs area, d is the effective depth and $f_{yv}$ is the yield strength of stirrups.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A method for fabricating a reinforced concrete wide shallow beam with increased shear resistance efficiency, comprising the steps of:

providing a plurality of rebars;

positioning said rebars in a parallel orientation to form an internal structure of a beam;

providing a plurality of stirrups;

positioning said plurality of stirrups around said plurality of rebars;

calculating an effective depth (d) of said plurality of rebars after said plurality of rebars have been positioned to form said internal structure of a beam;

calculating a longitudinal spacing ($s_L$) of said plurality of stirrups, wherein said longitudinal spacing ($s_L$) is comprised of a horizontal distance between each of said plurality of stirrups;

providing a plurality of legs;

determining a practical value for a transverse spacing ($s_w$) of said plurality of legs, wherein said transverse spacing ($s_w$) is comprised of a horizontal distance between each of said plurality of legs;

calculating an equivalent spacing ($s_{eq}$), wherein said equivalent spacing ($s_{eq}$) is calculated by $$s_{eq} = \left(\frac{s_L}{d}\right)^{0.25} \sqrt{s_L s_w} \geq s_L;$$

calculating an efficiency factor (λ), wherein said efficiency factor (λ) is calculated by $$\lambda = S_L/S_{eq};$$

maximizing said efficiency factor (λ) by repositioning said plurality of legs and said plurality of stirrups; and enclosing said plurality of said repositioned of legs, said plurality of said repositioned stirrups and said plurality of rebars in concrete to form said reinforced concrete beam.

2. The method for fabricating a reinforced concrete wide shallow beam with increased shear resistance efficiency of claim 1, calculating a maximum transverse spacing ($s_{w_{max}}$) of said plurality of legs, wherein said maximum transverse spacing ($s_{w_{max}}$) is calculated by $$s_{w_{max}} = \left(\frac{s_L}{d}\right)^{0.5} d;$$

and positioning each of said plurality of legs within said plurality of stirrups, wherein each of said plurality of legs is positioned a distance less than or equal to said maximum transverse spacing ($s_{w_{max}}$) from each other.

3. The method for fabricating a reinforced concrete wide shallow beam with increased shear resistance efficiency of claim 1, wherein each of said plurality of legs is positioned a distance equal to said maximum transverse spacing ($s_{w_{max}}$) from each other.

4. The method for fabricating a reinforced concrete wide shallow beam with increased shear resistance efficiency of claim 1, further comprising the step of calculating a shear strength ($V_n$) of said reinforced concrete wide shallow beam, wherein said shear strength ($V_n$) is calculated by the equation:

$$V_n = V_c + \lambda \frac{A_v f_{yv} d}{s_L},$$

where $V_c$ is equal to a shear strength contribution from concrete, $A_v$ is equal to a vertical legs area and $f_{yv}$ is equal to a yield strength of said stirrups.

5. The method for fabricating a reinforced concrete wide shallow beam with increased shear resistance efficiency of claim 1, wherein said plurality of stirrups fully enclose said plurality of rebars.

6. The method for fabricating a reinforced concrete wide shallow beam with increased shear resistance efficiency of claim 5, wherein said plurality of legs is comprised of two legs.

7. The method for fabricating a reinforced concrete wide shallow beam with increased shear resistance efficiency of claim 5, wherein said plurality of legs is comprised of four legs.

8. The method for fabricating a reinforced concrete wide shallow beam with increased shear resistance efficiency of claim 1, further comprising the step of positioning said reinforced concrete beam on a column.

9. A method for fabricating a reinforced concrete wide shallow beam with increased shear resistance efficiency, comprising the steps of:

providing a plurality of rebars;

positioning said rebars in a parallel orientation to form an internal structure of a beam;

providing a plurality of stirrups;

positioning said plurality of stirrups around said plurality of rebars;

calculating an effective depth (d) of said plurality of rebars after said plurality of rebars have been positioned to form said internal structure of a beam;

calculating a longitudinal spacing ($s_L$) of said plurality of stirrups, wherein said longitudinal spacing ($s_L$) is comprised of a horizontal distance between each of said plurality of stirrups;

providing a plurality of legs for each of said plurality of stirrups, wherein each of said plurality of stirrups fully enclose said plurality of rebars;

calculating a transverse spacing ($s_w$) of said plurality of legs, wherein said transverse spacing ($s_w$) is comprised of a horizontal distance between each of said plurality of legs, wherein said transverse spacing ($s_w$) is calculated by $$s_w = \left(\frac{s_L}{d}\right)^{0.5} d;$$

positioning each of said plurality of legs within said plurality of stirrups, wherein each of said plurality of legs is positioned a distance equal to said transverse spacing ($s_w$) from each other;

enclosing said plurality of legs based on said transverse spacing from each other, said plurality of stirrups and said plurality of rebars in concrete to form said reinforced concrete wide shallow beam; and positioning said reinforced concrete beam on a column.

10. The method for fabricating a reinforced concrete wide shallow beam with increased shear resistance efficiency of claim 9, further comprising the step of computing an efficiency factor in terms of transverse spacing ($s_w$), longitudinal spacing ($s_L$) and the effective depth (d).

11. The method for fabricating a reinforced concrete wide shallow beam with increased shear resistance efficiency of claim 9, wherein each of said plurality of legs is positioned a distance equal to said maximum transverse spacing ($s_{w_{max}}$) from each other.

12. The method for fabricating a reinforced concrete wide shallow beam with increased shear resistance efficiency of claim 9, wherein said plurality of stirrups fully enclose said plurality of rebars.

13. The method for fabricating a reinforced concrete wide shallow beam with increased shear resistance efficiency of claim 12, wherein said plurality of legs is comprised of two legs.

14. The method for fabricating a reinforced concrete wide shallow beam with increased shear resistance efficiency of claim 12, wherein said plurality of legs is comprised of four legs.

15. A method for fabricating a reinforced concrete wide shallow beam with increased shear resistance efficiency, comprising the steps of:

providing a plurality of rebars;

positioning said rebars in a parallel orientation to form an internal structure of a beam;

providing a plurality of stirrups;

positioning said plurality of stirrups around said plurality of rebars;

calculating an effective depth (d) of said plurality of rebars after said plurality of rebars have been positioned to form said internal structure of a beam;

calculating a longitudinal spacing ($s_L$) of said plurality of stirrups, wherein said longitudinal spacing ($s_L$) is comprised of a horizontal distance between each of said plurality of stirrups;

providing a plurality of legs;

calculating a transverse spacing ($s_w$) of each of said plurality of legs, wherein said transverse spacing ($s_w$) is comprised of a horizontal distance between each of said plurality of legs;

calculating an equivalent spacing ($s_{eq}$), wherein said equivalent spacing ($s_{eq}$) is calculated by $$s_{eq} = \left(\frac{s_L}{d}\right)^{0.25} \sqrt{s_L s_w} \geq s_L;$$

calculating an efficiency factor ($\lambda$), wherein said efficiency factor ($\lambda$) is calculated by $$\lambda = S_L / S_{eq};$$

maximizing said efficiency factor ($\lambda$) by repositioning said plurality of legs and said plurality of stirrups; and enclosing said plurality of said repositioned of legs, said plurality of said repositioned stirrups, said plurality of stirrups and said plurality of rebars in concrete to form said reinforced concrete beam.

* * * * *